US006109938A

United States Patent [19]

Meslet et al.

[11] Patent Number: 6,109,938

[45] Date of Patent: Aug. 29, 2000

[54] HERMAPHRODITIC ELECTRICAL SAFETY CONNECTOR

[75] Inventors: Franck Meslet; Rodrigue Cortiguera, both of Le Mans; Patrick Pennaneach, Plogonnec, all of France

[73] Assignee: Carrier Kheops BAC, Le Mans, France

[21] Appl. No.: 09/287,518

[22] Filed: Apr. 7, 1999

[30] Foreign Application Priority Data

Apr. 9, 1998 [FR] France ..... 98 04455

[51] Int. Cl.[7] ..... H01R 13/44

[52] U.S. Cl. ..... 439/139; 439/287; 439/140; 439/376

[58] Field of Search ..... 439/284, 287, 439/139, 342, 140, 376

[56] References Cited

U.S. PATENT DOCUMENTS

| | | | |
|---|---|---|---|
| 2,444,843 | 7/1948 | Modrey | 439/140 |
| 4,487,467 | 12/1984 | Guerrero et al. | 439/285 |
| 4,898,543 | 2/1990 | Benze | 439/374 |
| 4,913,514 | 4/1990 | Then | 350/96.21 |
| 5,104,333 | 4/1992 | Hatagishi et al. | 439/342 |
| 5,234,350 | 8/1993 | Marechal et al. | 439/139 |
| 5,478,249 | 12/1995 | Crestin | 439/138 |
| 5,564,934 | 10/1996 | Shimotsu | 439/139 |
| 5,685,727 | 11/1997 | Cairns | 439/139 |
| 5,697,798 | 12/1997 | Marechal | 439/139 |
| 5,800,196 | 9/1998 | Rudoy et al. | 439/284 |

*Primary Examiner*—Neil Abrams
*Assistant Examiner*—Hae Moon Hyeon
*Attorney, Agent, or Firm*—Scully, Scott, Murphy & Presser

[57] ABSTRACT

The invention relates to a safe hermaphroditic electrical connector.

This connector, consisting of two identical connector parts (1, 1') connected to each other in the service position, is characterized in that it has, for each connector part (1, 1'), at least one electrical contact (17, 17') located in the mid-plane of the connector, and a contact-blocking shutter (51, 51') which protects the contact (17, 17') from any intrusion and which opens during the mating of the connector parts (1, 1').

11 Claims, 7 Drawing Sheets

HERMAPHRODITIC ELECTRICAL SAFETY CONNECTOR

BACKGROUND OF THE INVENTION

The invention relates to a safe hermaphroditic connector, blocked off by masking of the contacts, and intended especially for power transmission.

It is known that a hermaphroditic electrical connector consists of two connector parts—a movable plug and a socket, which are strictly identical. Such a connector therefore limits the number of connector parts in store on account of the socket and the plug being identical and protects the corresponding plugging components, applied against each other, from the risk of becoming dirty. Moreover, power transmission at a voltage greater than 48 volts requires safe masking of the contacts.

DISCUSSION OF THE PRIOR ART

FR 2,703,844 teaches an electrical power connector consisting of a plug and a socket, the socket of which includes a rotary shutter which masks the live contacts. Nevertheless, this connector consists of a separate plug and a separate socket and does not exhibit the characteristic of hermaphroditism.

SUMMARY OF THE INVENTION

The subject of the invention is a safe hermaphroditic electrical connector, especially for power transmission, consisting of two identical connector parts connected to each other in the service position, characterized in that it has, for each connector part, at least one electrical contact located in the mid-plane of the connector, and a contact-blocking shutter which—protects the contact from any intrusions and which opens during the mating of the connector parts.

Mating takes place by presenting the opposing connector parts oriented at 180° to each other.

The said blocking shutter is advantageously mounted so as to rotate in the front of the said contact, being suitably oriented and shaped so that it closes off the access of the contact in the inactive position and makes the contact accessible during mating.

Although it may be driven positively, for example by a cam path, from the inactive closed position to the mating open position, it is advantageously elastically returned to the closed position, being made to open during mating by engagement of a projecting piece on the body of the other connector part.

Preferably, the contact is an end contact mounted so as to move and returned forward, axially, and likewise the blocking shutter may be mounted so as to move axially [lacuna] returned forward, so that, during mating, after the shutter has opened, the latter is driven rearward by means of the other connector part in order to allow pressure contacting of the said facing contacts of the connector parts.

Preferably, the blocking shutter is mounted so as to move in rotation, axially, in a movable assembly which is mounted so as to slide axially in the body and returned forward. Of course, the axial travel of the movable assembly or of the blocking shutter is greater than that of the contact (of the rear positional offset of the contact with respect to the assembly or to the blocking shutter).

Furthermore, the body of the connector includes a guiding path, for example having complementary studs and grooves, guiding the mating and the extraction of the connector parts, one with respect to the other, the mating being positionally lockable by a catching device, this being manually releasable and propelling the extraction of the connector parts during disconnection, in order to limit any electrical arcing phenomenon when breaking the contact.

BRIEF DESCRIPTION OF THE DRAWINGS

The invention is illustrated below with the aid of an embodiment and with reference to the appended drawings in which.

DETAILED DESCRIPTION OF PREFERRED EMBODIMENTS

Figure 1:
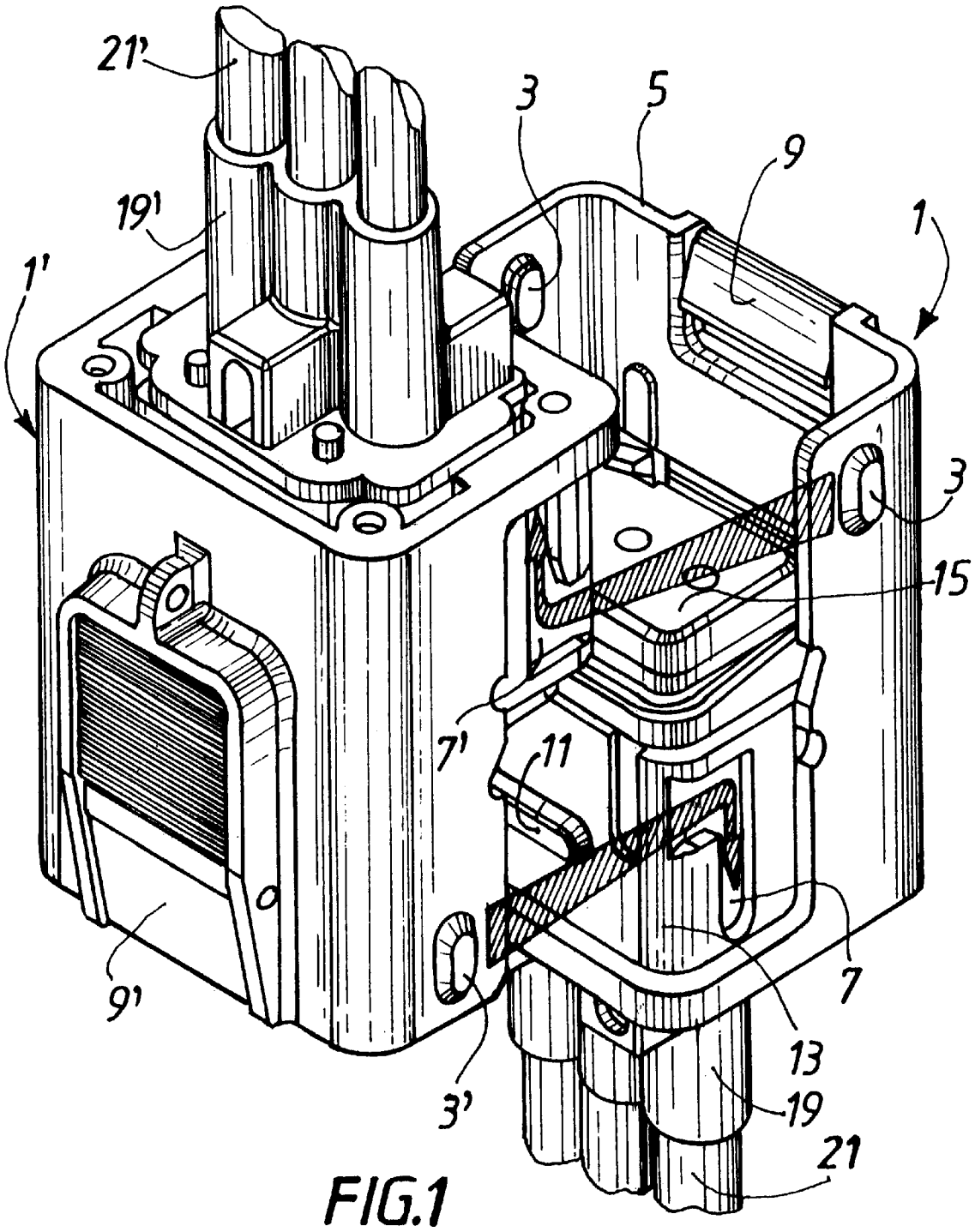
FIG. 1 is a perspective view of a hermaphroditic electrical connector according to the invention.

As shown in FIG. 1, the hermaphroditic electrical connector according to the invention consists of two identical connector parts 1 and 1' intended to be mated with each other, one opposite the other, by their front part.

It should be noted that all the numerical references of the connector part 1' will bear the "prime" symbol and will be used as such even if they are not all shown in the drawings.

One of the parts may be movable and may form the plug part of the connector and the other may form the socket part.

The mating is carried out by a transverse first movement and then an axial second movement (as shown by the arrows), the lateral studs 3 on the front skirt 5 of one of the connector parts 1 being engaged in complementary L-shaped grooves 7' in the other connector part 1', and vice versa in the case of the studs 3' in the grooves 7. The mating is locked at the end of mating by means of two opposed external catches 9 and 9', the nose 10, 10' of which on one of the parts engages in a respective complementary projecting part 11', 11 on the other (see FIG. 7).

Figure 2:
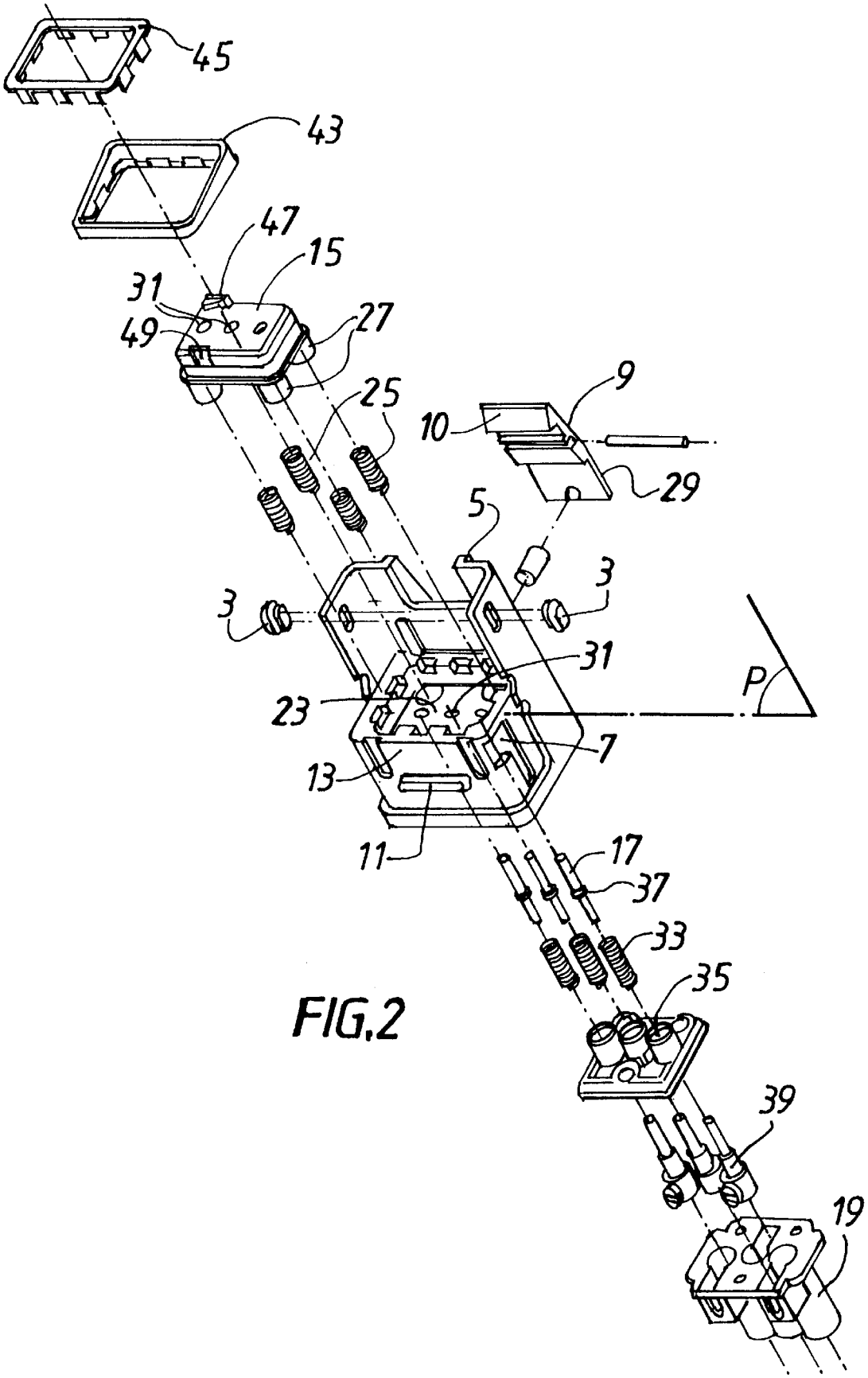
FIG. 2 is an exploded view of one of the connector parts.

Each connector part, as shown in FIG. 2, comprises a body 13, essentially in the form of a rectangular parallelepiped, provided with a front skirt 5, a front movable assembly 15, a lateral catch 9, internal contact pins 17 and a rear cap part 19 connected to the electrical conductor cables 21.

The front skirt 5 extends on one side of the body 13, the one of greater width, being cut with a U-shaped section, comprising the lateral catch 9 at its front end and two lateral studs 3 for guiding the mating, the studs being fixed to its wings.

The movable assembly 15 is mounted so as to slide axially in a front complementary recess 23 of the body and being returned forward by means of four springs 25 each mounted in a rear corner bush 27 of the assembly.

The lateral catch 9 is hinged to the upper wall of the skirt, being returned by its rear pusher part 29 upward in the direction of engagement on the other connector part.

The contact ping 17, three in number, are also mounted so as to slide axially in the body 13, passing through the later and the movable assembly 15 via suitable aligned drillholes 31, the contact pins being returned forward by helical springs 33 bearing in rear complementary shafts 35 of a baseplate of the body and on a central flange 37 of the pin 17. The pins 17 are located in a longitudinal mid-plane P.

Figure 6:
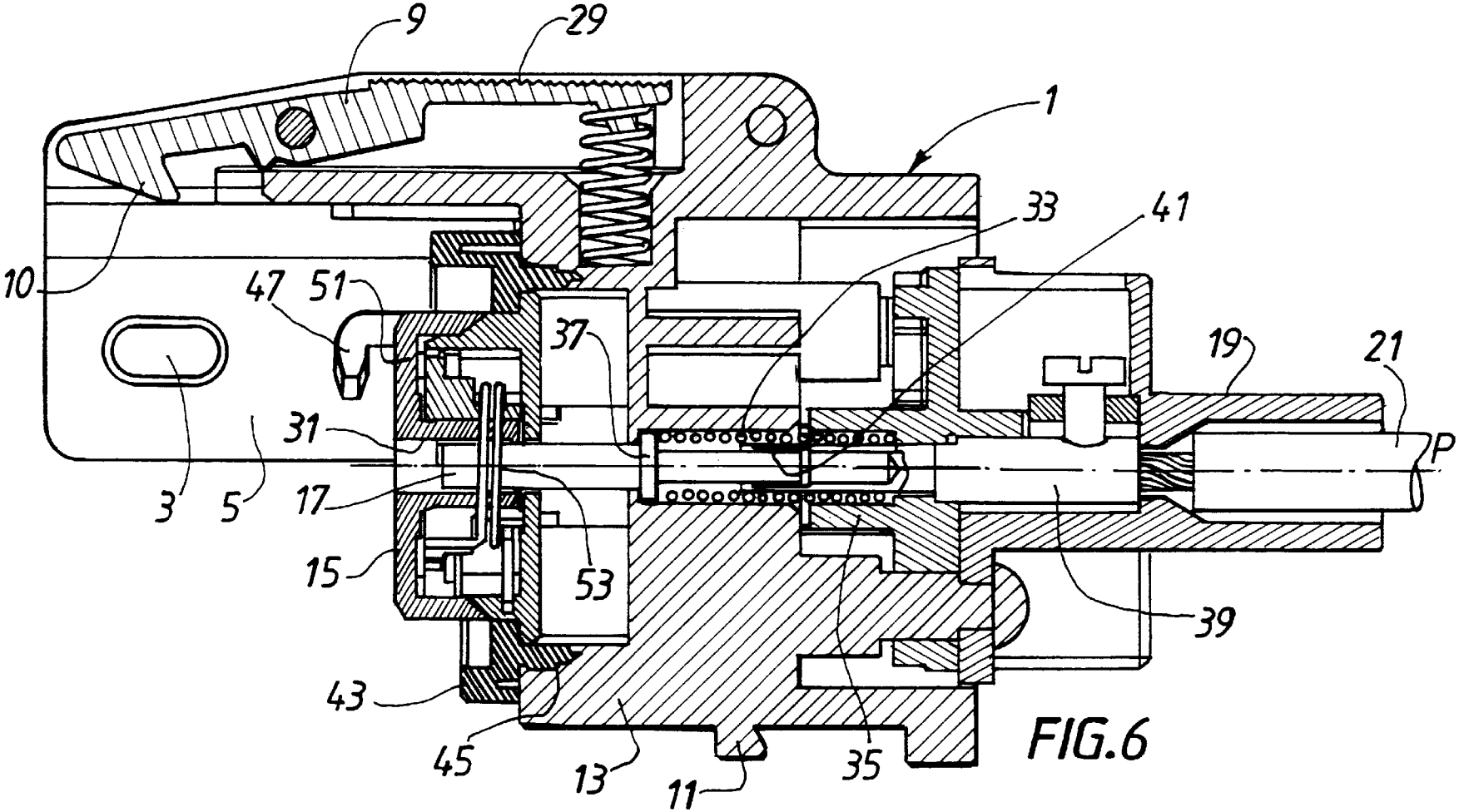
FIG. 6 is a lateral cross-section on the line B—B in FIG. 3 of a connector part.

The rear cap part 19 bears screw wire-clamping holders 39, to the rear of which the conductor cables 21 are fixed. The holders 39 have, in their front bush, internal cavities 41 which accommodate, with electrical contact connection, the electrical contact pins 17 mounted so as to slide inside by their rear part (see FIGS. 6, 7).

It should furthermore be noted that a peripheral flexible seal 43 fixed by means of a clamp 45 (see also FIG. 3) is located on the front part of the body, level with the movable assembly. This seal 43 applied against the top edge of the front recess 23 in the body is intended to bear in a sealed manner, against (FIG. 7) the corresponding seal 43' of the other connector part in the mated state.

Figure 3:
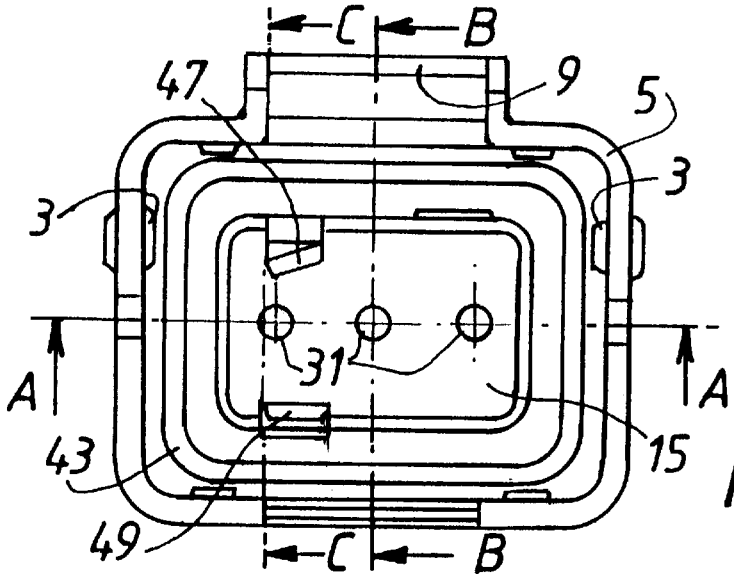
FIG. 3 is a front view of one of the connector parts.
Figure 4:
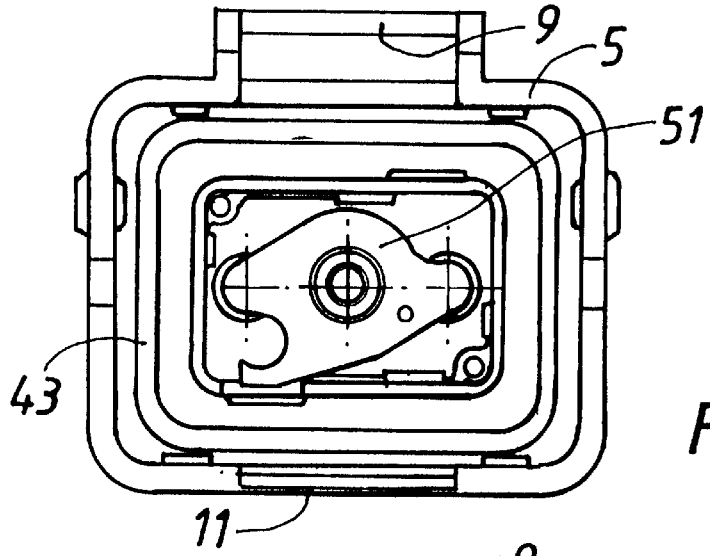
FIGS. 4 and 5 are front views of the connector, taken inside the movable assembly, showing the shutter in the blocked-off position and in the open position, respectively.
Figure 5:
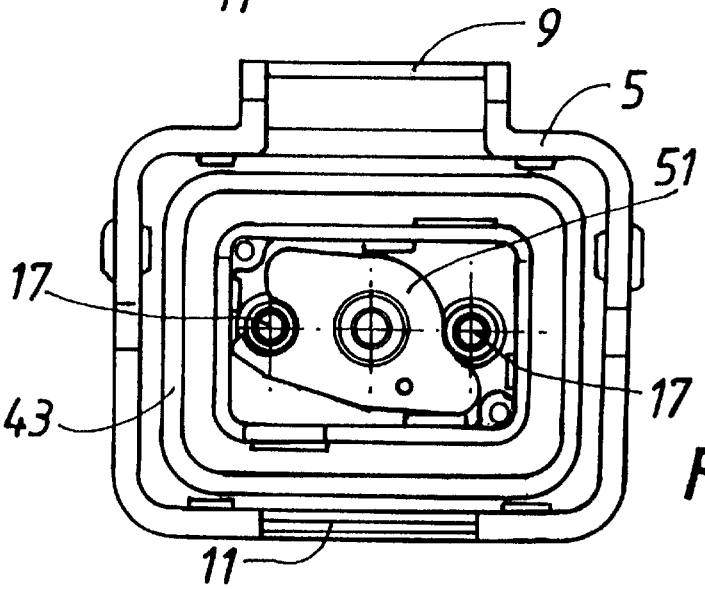

The front face of the movable assembly is clearly visible in FIG. 3. This movable assembly 15 has three holes 31 for passage of the contact pins 17 in the mated position, a front upper catch 47 and a lower recess 49 vertically in line with the catch 47. The catch 47 of a movable assembly 15 of one connector part 1 is intended to enter, upon mating (during the first transverse movement), the corresponding recess 49' in the movable assembly 15' of the other connector part 1'. Having done this, it results in the opening (FIG. 5) [lacuna] a shutter 51 for blocking off the contact pins, which is mounted so as to rotate axially inside the movable assembly and returned, when closed (FIG. 4), by means of a spiral spring 53 (seen in FIG. 6).

The operation of the connector will now be described. This involves presenting the two connector parts 1 and 1' face to face, these being oriented at 180° to each other, engaging the lateral studs 3 and 3' on the opposed skirts 5 and 5' in the guiding grooves 7' and 7 of the body, respectively, carrying out the transverse first movement of transverse mating, in which the blocking shutter 51 opens, and then carrying out, by manual, pressing the axial second movement of mating, after which the contact pins 17 and 17' are brought into end-to-end contact and in electrical connection.

Figure 7:
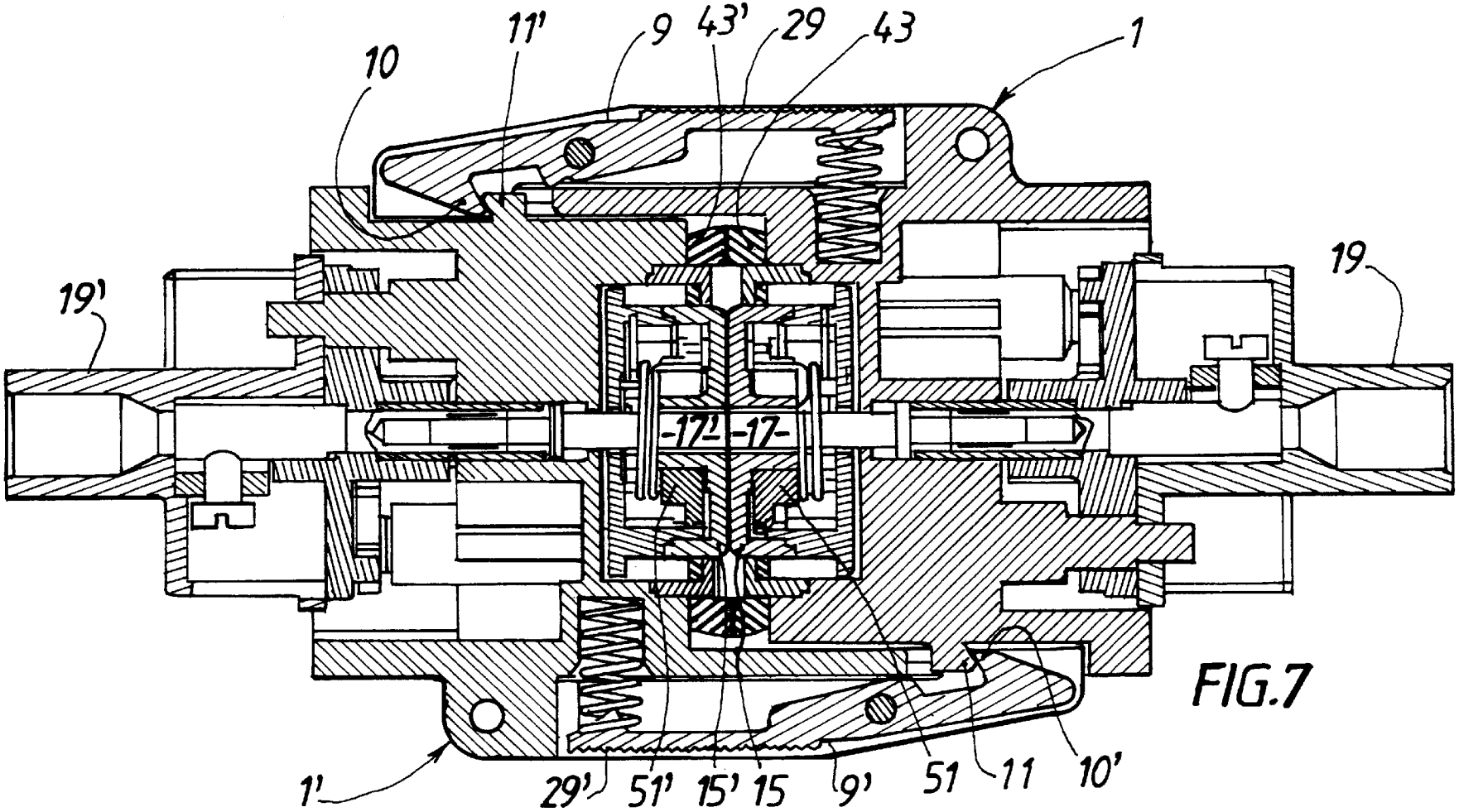
FIG. 7 is a view similar to the previous one of the mated connector.
Figure 8:
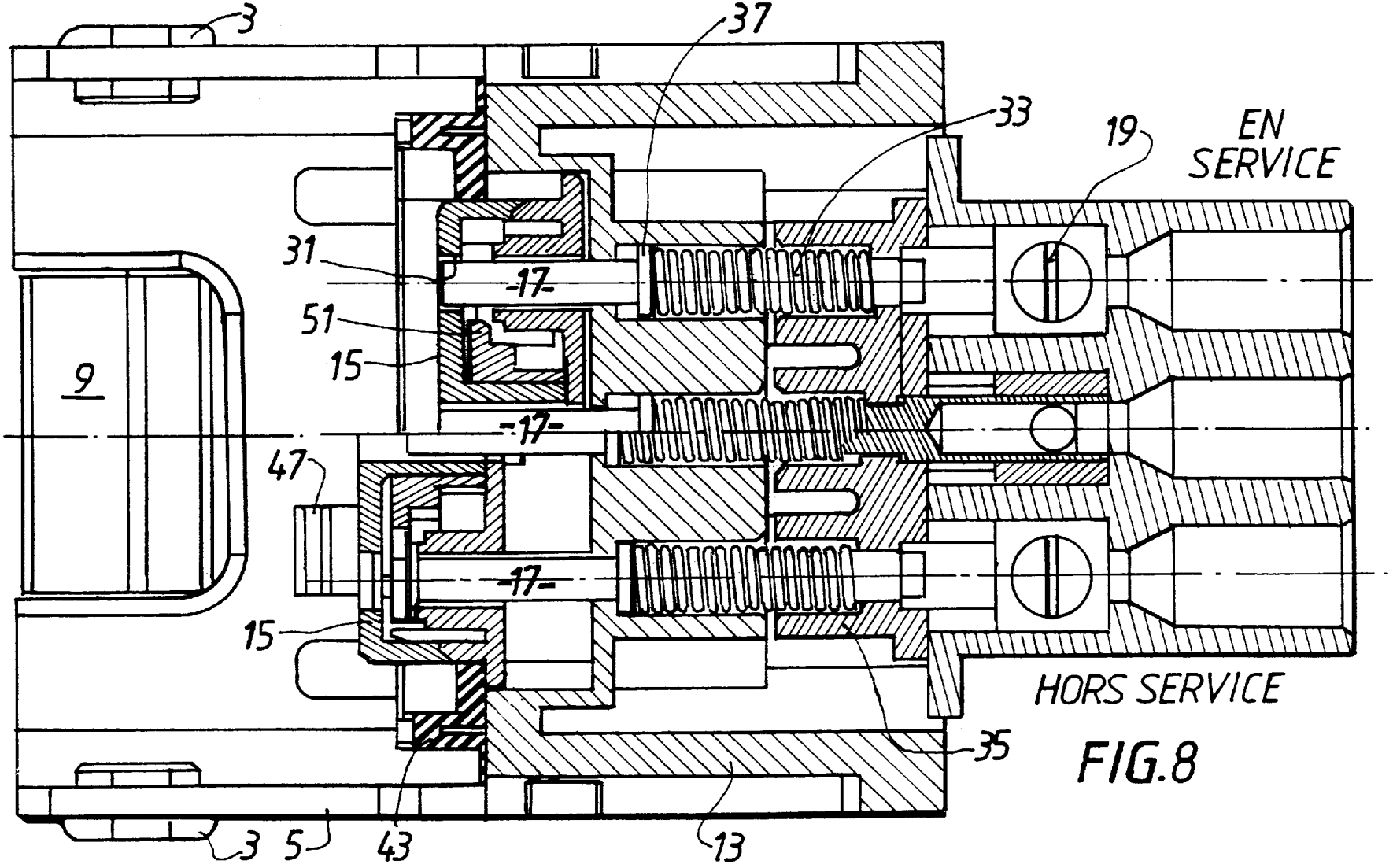
FIG. 8 shows two adjacent cross-sectional half-views on the line A—A in FIG. 3 of a connector part, in the extraction position and in the mating position, respectively.
Figure 9:
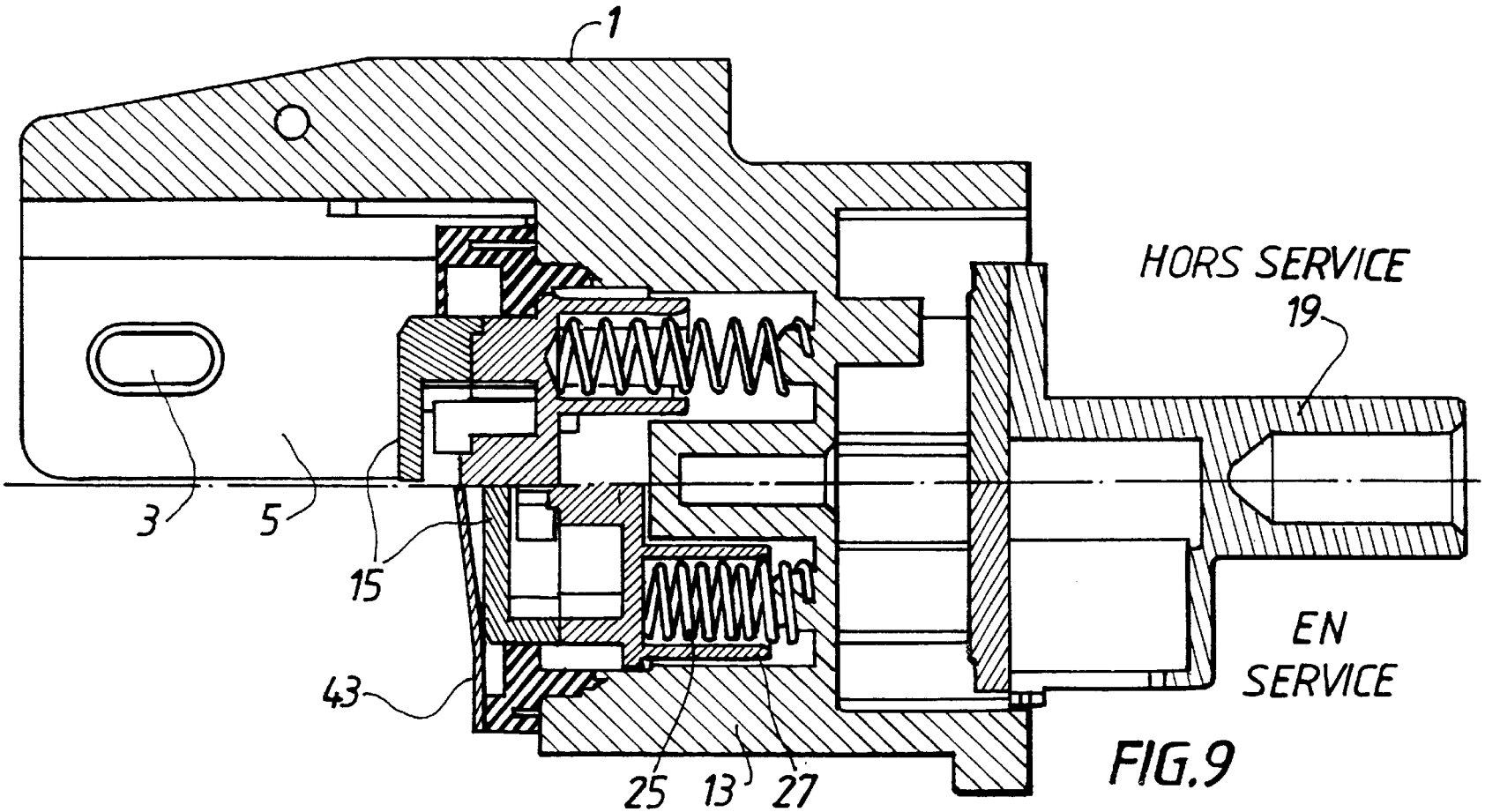
FIG. 9 shows two adjacent cross-sectional half-views on the line C—C in FIG. 3 of a connector part, in the extraction position and in the mating position, respectively.

In this second movement, the movable assemblies 15, 15' come up against each other and move backward (FIG. 9, lower half-view) under the mating pressure inside the body until the pins 17, 17' in their turn come into contact (FIGS. 7, 8). The axial mating is extended slightly until the pins are pressed toward each other, under the return of their spring 33, so as to ensure good electrical contact connection. At the end of the mating travel, the catches 9, 9' are automatically engaged on the complementary catching projections 11, 11', locking the mating.

Disconnection is obtained in the reverse manner, by pressing the two pushers 29, 29' of the catches 9, 9' simultaneously. There is therefore a first extraction, with automatic axial propulsion exerted on the axial guiding grooves 7, 7' of the bodies, under the thrust of the forwardly returned movable assemblies 15, 15' essentially against each other. Secondly, the connector parts are separated transversely in the opposite way to the first mating movement.

Alternative embodiments may be imagined within the scope of the invention, for example as regards the way in which the connector parts are guided one with respect to the other, the number of contacts, the possibility of having a movable shutter without a movable assembly, the possibility, for masking the contacts, of the blocking shutter moving translationally in the movable assembly, the locking of the connector, etc.

What is claimed is:

1. Safe hermaphroditic electrical connector, especially for power transmission, comprising two movable assemblies (15, 15') which are movable relative to each other, including two identical connectors parts (1, 1') connected to each other in the service position, characterized in that it has, for each connector part (1, 1'), at least one electrical contact (17, 17') located in the mid-plane (P) of the connector, and a contact-blocking shutter (51, 51') which protects the contact (17, 17') from any intrusion, and which opens during the mating of the connector parts (1, 1') said one movable assembly (15) having at least one hole (31) for passage of said contact (17), a front upper catch (47) and a lower recess (49) vertically aligned with the catch (47) and with the other movable assembly (15'), the catch (47) of the movable assembly (15) of one connector part (1) entering upon mating, during a first transverse movement facilitating a plugging-in perpendicular to a middle contact plane, and an axial plugging-in through a second movement parallel to the middle plane and relative to the contacts, a corresponding recess (49') in the other movable assembly (15') of the other connector part (1') and the catch (47'), so as to cause the contact blocking shutters (15, 15') of the connector parts being in contact with each other during mating after the blocking shutters have opened, in order to allow passage therethrough of the contacts (17, 17'), and being moved back inside a body of their respective connector part so that at the completion of travel, the contacts (17, 17') are positioned against each other and are in electrical connections.

2. Hermaphroditic electrical connector according to claim 1, characterized in that it is mated by presenting the opposing connector parts (1, 1') oriented at 180° to each other.

3. Hermaphroditic electrical connector according to claim 1, characterized in that the said blocking shutter (51, 51') is mounted so as to rotate in the front of the said contact (17, 17'), being suitably oriented and shaped so that it closes off the access of the contact (17, 17') in the inactive position and makes the contact accessible during mating.

4. Hermaphroditic electrical connector according to claim 3, characterized in that the blocking shutter (51, 51') is positively cammed from the inactive closed position to the mating open position.

5. Hermaphroditic electrical connector according to claim 1, characterized in that the blocking shutter (51, 51') is elastically returned to the closed position and is made to open during mating by engagement of a projecting piece (47, 47') on the body of the other connector part.

6. Hermaphroditic electrical connector according to claim 1, characterized in that the blocking shutter (51, 51') is mounted so as to move axially, being returned forward.

7. Hermaphroditic electrical connector according to claim 1 characterized in that the blocking shutter (51, 51') is mounted so as to move in rotation, axially, in respectively one said movable assembly (15, 15) which is mounted so as to slide axially in the body and returned forward.

8. Hermaphroditic electrical connector according to claim 1, characterized in that the said contact (17, 17') is an end contact mounted so as to move and returned forward, axially.

9. Hermaphroditic electrical connector according to claim 1, characterized in that each connector part (1, 1') includes a guiding path (3, 7; 3', 7'), having complementary studs (3, 3') and grooves (7, 7'), guiding the mating and the extraction of the connector parts, one with respect to the other, the mating being positionally lockable by a catching device (9, 9'), this being manually releasable and propelling the extraction of the connector parts (1, 1'), so as to limit any electrical arcing phenomenon when breaking the contact.

10. Hermaphroditic electrical connector according to claim 1, characterized in that the mating is carried out by a transverse first movement and then an axial second movement in which the lateral studs (3) on the front skirt (5) of one of the connector parts (1) are engaged in complementary L-shaped grooves (7') in the other connector part (1'), and vice versa in the case of the other connector part (1'), the mating being locked at the end of mating by means of two opposed external catches (9) and (9'), a nose of which, on one of the parts, engages in a respective complementary projecting part on the other.

11. Hermaphroditic connector according to claim 1, characterized in that it includes, for each connector part (1, 1') respectively, a peripheral flexible seal (43, 43') fixed by means of a clamp (45, 45') located on the front part of the body, level with the movable assembly (15, 15'), this seal (43, 43') being applied against the top edge of the front recess (23, 23') in the body and intended to bear, in a sealed manner, against the corresponding seal (43, 43') of the other connector part in the mated state.

* * * * *